US009828839B2

(12) United States Patent
Powers et al.

(10) Patent No.: US 9,828,839 B2
(45) Date of Patent: Nov. 28, 2017

(54) BARRIER DEVICE WITH FLUID BYPASS FOR MULTI-ZONE WELLBORES

(71) Applicants: Geoffrey York Powers, Houston, TX (US); Kelly D. Ireland, Conroe, TX (US)

(72) Inventors: Geoffrey York Powers, Houston, TX (US); Kelly D. Ireland, Conroe, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 328 days.

(21) Appl. No.: 14/460,949

(22) Filed: Aug. 15, 2014

(65) Prior Publication Data

US 2016/0047190 A1 Feb. 18, 2016

(51) Int. Cl.
*E21B 43/04* (2006.01)
*E21B 43/14* (2006.01)
*E21B 43/267* (2006.01)

(52) U.S. Cl.
CPC ..... *E21B 43/14* (2013.01); *E21B 43/267* (2013.01)

(58) Field of Classification Search
CPC .. E21B 33/1294; E21B 33/1285; E21B 43/04; E21B 43/14
USPC ..... 166/129, 126, 142–151
See application file for complete search history.

(56) References Cited

U.S. PATENT DOCUMENTS 3,313,350 A * 4/1967 Page, Jr. ..... E21B 34/10 137/395
3,410,348 A * 11/1968 Page ..... E21B 33/1294 166/120
4,566,538 A * 1/1986 Peterson ..... E21B 33/1295 166/278
4,638,859 A * 1/1987 Zunkel ..... E21B 33/1292 166/126
6,230,803 B1 * 5/2001 Morton ..... E21B 43/045 166/278
2013/0161000 A1 * 6/2013 Broussard ..... E21B 33/1208 166/278
2015/0041130 A1 * 2/2015 Cleveland ..... E21B 43/04 166/276
2015/0075780 A1 * 3/2015 Richards ..... E21B 17/04 166/250.1
2015/0285038 A1 * 10/2015 Yeh ..... E21B 43/04 166/278

* cited by examiner

*Primary Examiner* — Kipp Wallace
(74) *Attorney, Agent, or Firm* — Cantor Colburn LLP

(57) ABSTRACT

In one aspect, a device for use in a wellbore includes a tubular body; a barrier member associated with an outer surface of the tubular body configured to retain a proppant; an actuating member associated with the barrier member configured to expand the barrier member in an annular direction; and a fluid channel associated with an upper extent and a lower extent of the barrier member, configured to allow a fluid flow therethrough. In another aspect, a method for completing a multi-zone wellbore, includes deploying a barrier device at a downhole location within the wellbore; expanding a barrier member in an annulus of the wellbore; providing proppant in the annulus of the wellbore; retaining the proppant in the annulus via the barrier member; and providing a fluid flow between an upper extent and a lower extent of the barrier member.

20 Claims, 3 Drawing Sheets

BARRIER DEVICE WITH FLUID BYPASS FOR MULTI-ZONE WELLBORES

BACKGROUND

1. Field of the Disclosure

This disclosure relates generally to barrier devices to facilitate accumulation of proppant and a fluid flow therethrough.

2. Background

Wellbores are drilled in subsurface formations for the production of hydrocarbons (oil and gas). Hydrocarbons are trapped in various traps or zones in the subsurface formations at different depths. Such zones are referred to as reservoirs or hydrocarbon-bearing formations or production zones. In production zones, it is often desired to perform completion operations such as fracing, frac packing, or gravel packing operations to stabilize the wellbore and facilitate production within the production zones. When there is a great distance between zones such completion operations often require a large amount of proppant, such as sand, gravel or other materials. In a multi-zone well bore, it is often desired to minimize the amount of proppant required for completion operations.

The disclosure herein provides a barrier device to minimize the amount of proppant required for completion operations by facilitating accumulation of proppant and a fluid flow therethrough.

SUMMARY

In one aspect, a device for use in a wellbore includes a tubular body; a barrier member associated with an outer surface of the tubular body configured to retain a proppant; an actuating member associated with the barrier member configured to expand the barrier member in an annular direction; and a fluid channel associated with an upper extent and a lower extent of the barrier member, configured to allow a fluid flow therethrough.

In another aspect, a system for use in a wellbore includes a tubing string; a service tool configured to provide a proppant in an annulus around the tubing string; and a barrier device including a tubular body associated with the tubing string; a barrier member associated with an outer surface of the tubular body configured to retain the proppant; an actuating member associated with the barrier member configured to expand the barrier member in the annulus; and a fluid channel associated with an upper extent and a lower extent of the barrier member, configured to allow a fluid flow therethrough.

In another aspect, a method for completing a multi-zone wellbore includes deploying a barrier device at a downhole location within the wellbore; expanding a barrier member of the barrier device in an annulus of the wellbore; providing proppant in the annulus of the wellbore; retaining the proppant in the annulus via the barrier member; and providing a fluid flow between an upper extent and a lower extent of the barrier member.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
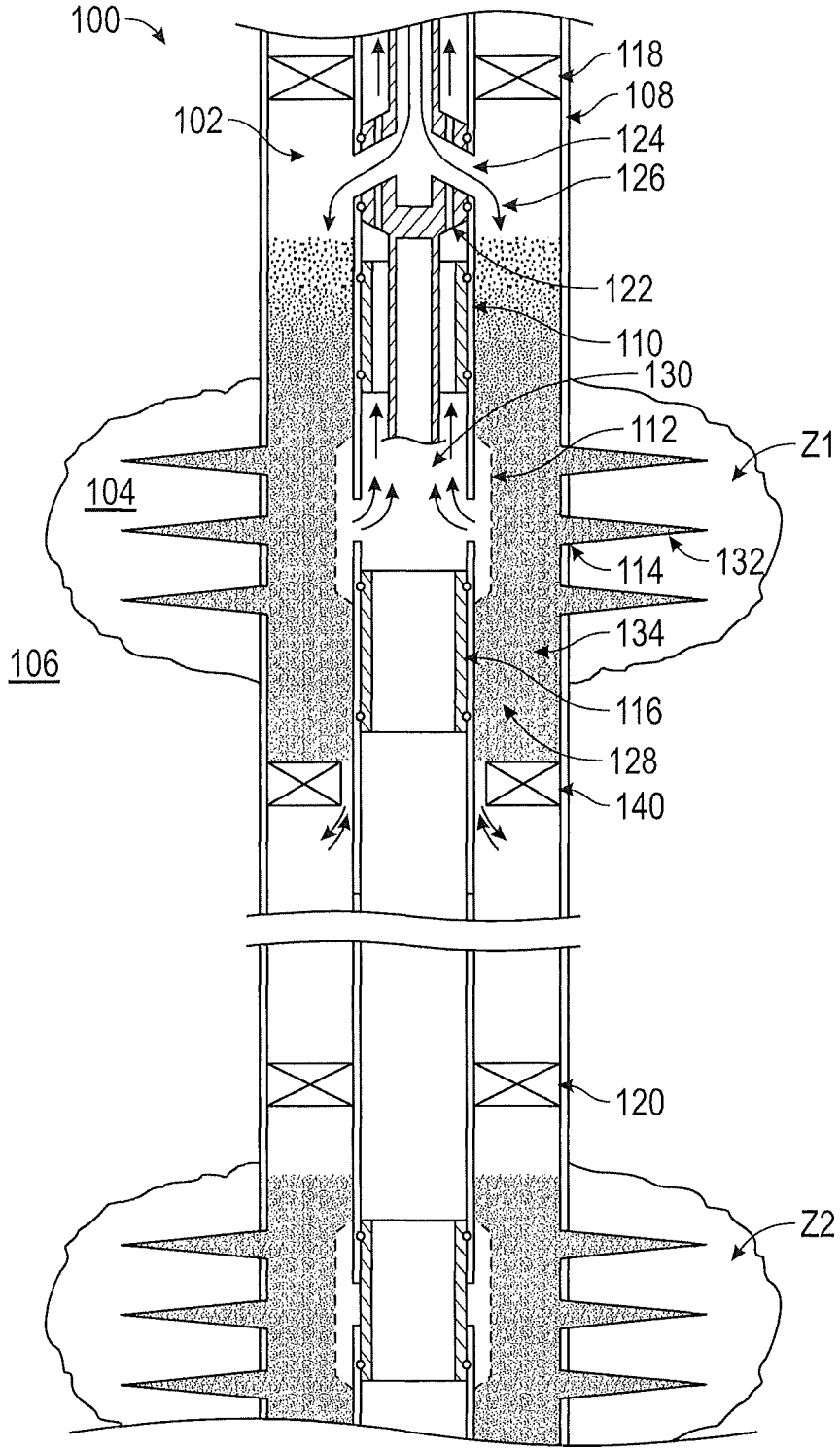
FIG. 1 shows an exemplary wellbore system that includes a barrier device, according to one non-limiting embodiment of the disclosure.

FIG. 1 is a line diagram of a wellbore system 100 that may be used for completion operations in a formation 104 with multiple production zones Z1, Z2, etc. In an exemplary embodiment, the system 100 includes a casing 108 cemented in wellbore 102 formed in a formation 104. In an alternative embodiment, wellbore 102 is provided in an open hole without casing 108. Tubing 110 is deployed within wellbore 102 to a downhole location 106.

Tubing 110 may extend to multiple zones Z1, Z2, etc within wellbore 102. Each zone, such as zone Z1, may be isolated within wellbore 102 and annulus 134 by packers 118, 120. An isolation packer 120 isolates zone Z1 from lower zones, such as zone Z2 and other portions of formation 104. Top packer 118 similarly isolates zone Z1 from zones above Z1 and other portions of formation 104.

During completion operations, a crossover tool 122 may be introduced into the wellbore 102. Crossover tool 122 is deployed within tubing string 110 to a downhole location 106. Crossover tool 122 introduces proppant flow 126 into an isolated zone, such as zone Z1, to stabilize the wellbore 102 and stimulate production of formation fluids 130. Proppant may include sand, gravel, and other completion materials to facilitate fracing, frac packing, and gravel packing operations. Proppant flow 126 crosses over into annulus 134 via a frac sleeve 124 of tubing string 110. Such proppant flow 126 is provided under pressure into the annulus 134 to fill the isolated zone Z1. Proppant flow 126 accumulates as packed material 128 (gravel pack) and enters formation 104.

Casing 108 has perforations 114 to allow proppant flow 126 into formation 104. As packed material 128 accumulates, proppant flow 126 flows through perforations 114 of casing 108. Proppant flows along a preferred plane to interface with formation 104. Fractures 132 in formation 104 may be created, expanded, or structurally supported by the flowed proppant 126. Proppant flow 126 may include materials of different sizes and densities to create, expand and support fractures 132 within formation 104. Such fractures 132 facilitate and enhance the production of formation fluids 130 such as oil and gas.

Completion operations may continue until the production zone Z1 is fully treated. A zone is considered treated when packed material 128 has interacted with the of zone Z1 up to the well screen 112 that will receive formation fluid flow 130. When the well screen 112 has been covered by packed material 128, a rise in pressure indicates to the operator a "screen out" condition is achieved, signaling the completion operation has finished. A well screen 112 prevents proppant and other solids from entering tubing string 110.

Conventionally, proppant flow 126 must flow the entire length of isolated zone Z1 and accumulate as packed material 128 above isolation packer 120 to accumulate and create a desired "screen out" condition. If there is a great distance between zones (such as thousands of feet), a large amount of proppant must be used. To reduce the amount of proppant used to complete a zone, wellbore system 100 includes barrier device 140. Barrier device 140 is disposed immediately down hole of zone Z1 and allows packed material 128 to accumulate directly below zone Z1 while allowing fluid flow therethrough to maintain a neutral pressure differential. Accordingly, less proppant flow 126 is required to achieve a "screen out" condition.

Figure 2A:
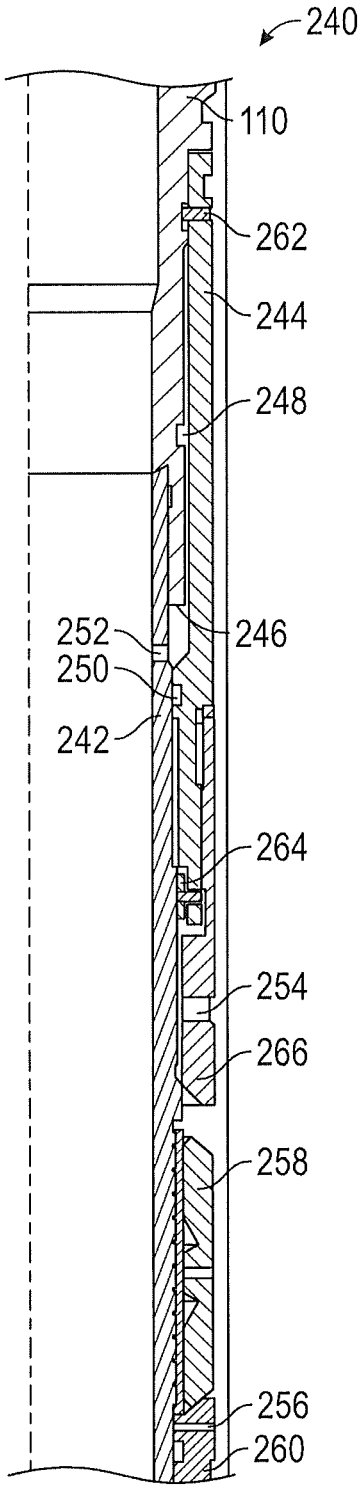
FIG. 2A shows a partial cross-section about centerline 'C' of a non-limiting embodiment of a barrier device for use in wellbore system, including the wellbore system shown in FIG. 1, for deployment in a wellbore, such as wellbore shown in FIG. 1.
Figure 2B:
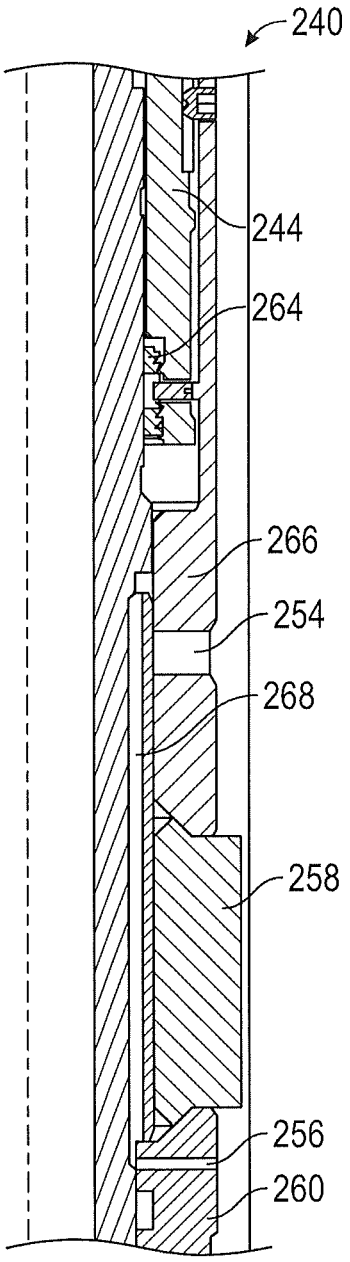
FIG. 2B shows a partial cross-section about centerline 'C' of the barrier device of FIG. 2A with the barrier member in an expanded position.
Figure 2C:
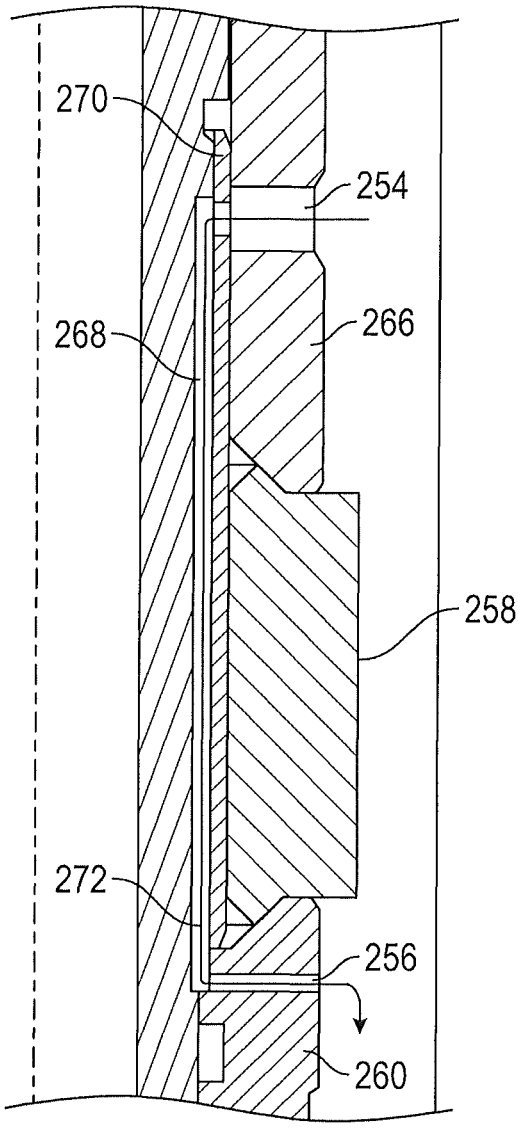
FIG. 2C shows a partial cross-section about centerline 'C' of the fluid channel of the barrier device of FIG. 2A.

A non-limiting embodiment of the barrier device for use in the wellbore system 100 is described in reference to FIGS. 2A-2C.

FIG. 2A shows a partial cross-section about centerline 'C' of a non-limiting embodiment of a barrier device for use in wellbore system, including the wellbore system shown in FIG. 1, for deployment in a wellbore, such as wellbore shown in FIG. 1. Barrier device 240 includes tubular body 242, an actuator body 266, and a barrier member 258.

Tubular body 242 of barrier device 240 is associated with tubing string 110. In an exemplary embodiment, tubular body 242 is threadedly coupled with tubing string 110. Barrier device 240 may be coupled inline with tubing string 110. Tubular body 242 has an inner diameter that allows a flow therethough, such as flow 130 (FIG. 1) of formation fluids. Actuator body 266 and barrier member 258 are generally disposed on the outer surface of tubular body 242.

Actuator body 266 is disposed on the outer surface of tubular body 242 and is configured to expand barrier member 258. In an exemplary embodiment, actuator body 266 utilizes pressure received from within tubular body 242 and tubing string 110. In other embodiments, actuator body 266 is actuated by mechanical means or any other suitable means.

In an exemplary embodiment, piston 244 is associated with actuator body 266. Piston area 246 of piston 244 is in fluid communication with a pressure within tubular body 242 and tubing string 110. A port 252 directs fluid pressure to a piston area 246. Fluid pressure urges piston area 246 and piston 244 generally downward along on the outside surface of tubular body 242, while an upper seal 248 and a lower seal 250 contain fluid pressure within piston area 246.

In an exemplary embodiment, actuator body 266 is fixed or retained until a desired pressure or force applied. Selectively retaining actuator body 266 allows for barrier device 240 to be run into wellbore 102 without deploying barrier member 258 or otherwise deploying barrier member 258 unintentionally. Shear screw 262 is associated with piston 244 to restrict movement of piston 244 and actuator body 266 until a determined force is applied. When such a determined force is applied, the shear screw 262 is sheared and the piston 244 may move downwardly. In other embodiments, actuator body 266 is selectively retained by other suitable means.

Barrier member 258 is configured to accumulate proppant and prevent proppant from passing therethrough. Barrier member 258 may be a resilient material or an elastomeric material, including polymer and rubber. The use of a resilient material for barrier member 258 further allows the barrier device 240 to easily be retrieved. If the barrier device 240 is prematurely set, a straight pull to the barrier device 240 will strip material off the barrier member 258 allowing retrieval from the wellbore 102.

In other embodiments, barrier member 258 is a screen or mesh type material to allow fluid flow therethrough while retaining proppant.

FIG. 2B shows a partial cross-section about centerline 'C' of the barrier device of FIG. 2A with the barrier member 258 in an expanded position. In an exemplary embodiment, actuator body 266 moves downwardly to compress barrier member 258 against a fixed bottom sub 260. As a result of this compression in a longitudinal direction barrier member 258 expands radially outward. In an exemplary embodiment barrier member 258 expands toward wellbore 102 or casing 108 to form a sealing relationship.

In an exemplary embodiment, locking member 264 retains actuator body 266 in a lowered position, to allow barrier member 258 to remain in an expanded state. Locking member 264 may use any suitable means to lock actuator body 266 in a downward position. In an exemplary embodiment, locking member 264 is a ratchet locking mechanism that allows actuator body 266 to move downwardly in one direction, by allowing teeth of such a mechanism to move downwardly, but resists the movement of the actuator body 266 in an opposite upward direction. Such a locking member 264 may be desirable when actuator body 266 is actuated by fluid pressure. When pressure is relieved, locking mechanism 264 may retain the piston in a downward state, allowing retention of the expanded state of barrier member 258.

FIG. 2C shows a partial cross-section about centerline 'C' of the fluid channel of the barrier device of FIG. 2A. When barrier member 258 is deployed, fluid flow 272 may be restricted therethough. During completion operations, it is desirable to maintain neutral pressure or otherwise prevent the accumulation of differential pressure above and below barrier device 140. Fluid channel 268 allows fluid flow 272 to pass from an upper extent of barrier member 258 to a lower extent of barrier member 258 when barrier member 258 is deployed. Fluid flow 272 enters above barrier member 258 at upper channel opening 254. Fluid flow 272 continues beyond barrier member 258 to exit via lower channel opening 256. Fluid flow 272 may flow in an opposite direction to achieve neutral pressure or otherwise freely transfer pressure within the zone. Advantageously, maintaining a neutral pressure environment allows for packers to be set downhole without compressing fluid in the annulus between the isolation packer 120 and barrier device 140 if required. Attempting to set the isolation packer 120 against a trapped volume of fluid may prevent the packer from completely and successfully setting. In an exemplary embodiment, fluid channel 268 is disposed between barrier member 258 and tubular body 242. In certain embodiments a screen 270 may be disposed between fluid channel 268 and barrier member 258 to allow an adequate separation and a flow path therethrough. In certain embodiments, the fluid channel 268 is formed from a coarse thread, or an otherwise rough or uneven surface to allow flow therethrough. In an alternative embodiment, fluid channel 268 is disposed within barrier member 258. In certain embodiments, barrier member 258 selectively allows a fluid flow 272 therethrough without the use of a dedicated fluid channel 268.

Advantageously, the use of barrier device 240 allows for less proppant to be used, while still allowing for wellbore integrity. Less proppant is used in multi-zone completions, and particularly, where a great distance separates production zones. Accordingly, less wear on service equipment, such as crossover tool 122, is experienced. Further, since less proppant is required, completion operations can be completed faster compared to conventional methods. Additionally, due to the configuration of the barrier device 240, barrier device 240 can be produced for a relatively low cost.

Therefore in one aspect, the present disclosure provides a device for use in a wellbore includes a tubular body; a barrier member associated with an outer surface of the tubular body configured to retain a proppant; an actuating member associated with the barrier member configured to expand the barrier member in an annular direction; and a fluid channel associated with an upper extent and a lower extent of the barrier member, configured to allow a fluid flow therethrough. In certain embodiments, the actuating member including a piston in fluid communication with a tubular pressure associated with the tubular body. In certain embodiments, the actuating member including a locking member configured to retain a position of the actuating member. In certain embodiments, the actuating member including a biasing member configured to retain an initial position of the actuating member up to a predetermined force. In certain embodiments the fluid channel is disposed within the barrier member. In certain embodiments, the fluid channel is disposed between the outer surface of the tubular body and the barrier body.

In another aspect, the present disclosure provides a system for use in a wellbore includes a tubing string; a service tool configured to provide a proppant in an annulus around the tubing string; and a barrier device including a tubular body associated with the tubing string; a barrier member associated with an outer surface of the tubular body configured to retain the proppant; an actuating member associated with the barrier member configured to expand the barrier member in the annulus; and a fluid channel associated with an upper extent and a lower extent of the barrier member, configured to allow a fluid flow therethrough. In certain embodiments, the actuating member including a piston in fluid communication with a tubular pressure associated with the tubular body. In certain embodiments, the actuating member including a locking member configured to retain a position of the actuating member. In certain embodiments, the actuating member including a biasing member configured to retain an initial position of the actuating member up to a predetermined force. In certain embodiments the fluid channel is disposed within the barrier member. In certain embodiments, the fluid channel is disposed between the outer surface of the tubular body and the barrier body. In certain embodiments, the barrier device is disposed immediately downhole of a production zone. In certain embodiments, the barrier device is disposed above a second downhole production zone.

In another aspect, the present disclosure provides a method for completing a multi-zone wellbore, includes deploying a barrier device at a downhole location within the wellbore; expanding a barrier member of the barrier device in an annulus of the wellbore; providing proppant in the annulus of the wellbore; retaining the proppant in the annulus via the barrier member; and providing a fluid flow between an upper extent and a lower extent of the barrier member. In certain embodiments, further including deploying the barrier device immediately downhole of a production zone. In certain embodiments, further including deploying the barrier device above a second downhole production zone. In certain embodiments, further including providing a tubular pressure to a piston associated with the barrier member. In certain embodiments further including resisting an expansion of the barrier member until a predetermined force is applied to the piston. In certain embodiments, further including retaining an expansion of the barrier member.

The invention claimed is:

1. A device for use in a wellbore, comprising:

a tubular body defining an annulus in the wellbore;

a barrier member associated with an outer surface of the tubular body configured to retain a proppant, wherein the barrier is deployed in the wellbore by the tubular member;

an actuating member associated with the barrier member configured to expand the barrier member in an annular direction; and a fluid channel disposed between the barrier member and the outer surface of the tubular body with an upper channel opening disposed above the barrier member for fluid communication with the annulus and a lower channel opening disposed below the barrier member for fluid communication with the annulus, the fluid channel configured to allow a fluid flow therethrough;

wherein the actuating member includes an opening that is aligned with the upper channel opening of the fluid channel when the barrier member is expanded and is non-aligned with the upper channel opening when the barrier member is not expanded.

2. The device of claim 1, wherein the actuating member includes a piston in fluid communication with a tubular pressure associated with the tubular body.

3. The device of claim 1, wherein the actuating member includes a locking member configured to retain a position of the actuating member.

4. The device of claim 1, wherein the actuating member includes a shear member configured to retain an initial position of the actuating member up to a predetermined force.

5. The device of claim 1, wherein the fluid channel is disposed within the barrier member.

6. The device of claim 1, wherein the fluid channel is disposed between the outer surface of the tubular body and the barrier member.

7. A system for use in a wellbore, comprising:

a tubing string;

a service tool configured to provide a proppant in an annulus around the tubing string; and a barrier device comprising:

a tubular body associated with the tubing string, the tubular body defining an annulus in the wellbore, wherein the barrier is deployed in the wellbore by the tubular member;

a barrier member associated with an outer surface of the tubular body configured to retain the proppant;

an actuating member associated with the barrier member configured to expand the barrier member in the annulus; and a fluid channel disposed between the barrier member and the outer surface of the tubular body with an upper channel opening disposed above the barrier member for fluid communication with the annulus and a lower channel opening disposed below the barrier member for fluid communication with the annulus, the fluid channel configured to allow a fluid flow therethrough;

wherein the actuating member includes an opening that is aligned with the upper channel opening of the fluid channel when the barrier member is expanded and is non-aligned with the upper channel opening when the barrier member is not expanded.

8. The system of claim 7, wherein the actuating member includes a piston in fluid communication with a tubular pressure associated with the tubular body.

9. The system of claim 7, wherein the actuating member includes a locking member configured to retain a position of the actuating member.

10. The system of claim 7, wherein the actuating member includes a shear member configured to retain an initial position of the actuating member up to a predetermined force.

11. The system of claim 7, wherein the fluid channel is disposed within the barrier member.

12. The system of claim 7, wherein the fluid channel is disposed between the outer surface of the tubular body and the barrier member.

13. The system of claim 7, wherein the barrier device is disposed immediately downhole of an initial production zone.

14. The system of claim 13, wherein the barrier device is disposed above a downhole production zone disposed below the initial production zone.

15. A method for completing a multi-zone wellbore, comprising:

deploying a barrier device at a downhole location via a tubular body within the wellbore wherein the tubular body defines an annulus in the wellbore:

expanding a barrier member of the barrier device into the annulus of the wellbore via an actuating member;

providing proppant in the annulus of the wellbore;

retaining the proppant in the annulus via the barrier member; and providing a fluid flow in a channel disposed between the barrier member and the outer surface of the tubular body with an upper channel opening disposed above the barrier member for fluid communication with the annulus and a lower channel opening disposed below the barrier member for fluid communication with the annulus;

wherein the actuating member includes an opening that is aligned with the upper channel opening of the fluid channel when the barrier member is expanded and is non-aligned with the upper channel opening when the barrier member is not expanded.

16. The method of claim 15, further comprising deploying the barrier device immediately downhole of an initial production zone.

17. The method of claim 16, further comprising deploying the barrier device above a downhole production zone disposed below the initial production zone.

18. The method of claim 15, further comprising providing a tubular pressure to a piston associated with the barrier member.

19. The method of claim 18, further comprising resisting an expansion of the barrier member until a predetermined force is applied to the piston.

20. The method of claim 15, further comprising retaining an expansion of the barrier member.

* * * * *